US005428932A

United States Patent [19]

Gruber

[11] Patent Number: 5,428,932

[45] Date of Patent: Jul. 4, 1995

[54] WALL PANEL, IN PARTICULAR DOUBLE-WALL PANEL

[76] Inventor: Eva Gruber, R. Riemannstr. 9, 5700 Zell am See, Austria

[21] Appl. No.: 197,486

[22] Filed: Feb. 16, 1994

[30] Foreign Application Priority Data

Feb. 17, 1993 [DE] Germany ..... 9302320 U

[51] Int. Cl.[6] ..... E04B 2/28

[52] U.S. Cl. ..... 52/587.1; 52/425; 52/588.1; 52/592.1; 249/47; 249/192

[58] Field of Search ..... 52/587.1, 590.2, 591.2, 52/592.1, 424, 425, 426, 580, 270, 271, 588.1; 249/47, 192, 196, 6, 44; 403/364, 341, 331

[56] References Cited

U.S. PATENT DOCUMENTS

| | | | |
|---|---|---|---|
| 523,076 | 7/1894 | Loftie | 52/592.1 |
| 1,500,377 | 7/1924 | Dodson | 52/592.1 |
| 2,189,218 | 2/1940 | Neumeister | 52/591.2 |
| 3,751,867 | 8/1973 | Layne | 52/426 |
| 4,655,014 | 4/1987 | Krecke | 52/426 |

FOREIGN PATENT DOCUMENTS

| | | | |
|---|---|---|---|
| 520600 | 6/1955 | Belgium | 52/592.1 |
| 912800 | 8/1946 | France | 52/588.1 |
| 1169265 | 12/1958 | France | 52/592.1 |
| 1070036 | 5/1967 | United Kingdom | 249/192 |
| 1557294 | 4/1990 | U.S.S.R. | 249/192 |

*Primary Examiner*—Carl D. Friedman
*Assistant Examiner*—Laura A. Saladino
*Attorney, Agent, or Firm*—Finnegan, Henderson, Farabow, Garrett and Dunner

[57] ABSTRACT

A wall panel, especially double-wall panel, for building a large shuttering wall, from a plurality of wall panels whose lateral abutment edges flushly abut each other, the wall panel comprising a main plate having rectilinear first and second lateral abutment edges parallel to each other on a first large face of the main plate. On the other large face of the main plate a platelike suspension tooth obliquely and descendingly projecting from the first abutment edge is arranged behind the first abutment edge, while a suspension recess adapted to the suspension tooth is arranged behind the second abutment edge. Thereby, the wall panels can be slidingly suspended into each other, until the abutment edges of the two wall panels adjoining each other come into contact with one another.

12 Claims, 6 Drawing Sheets

WALL PANEL, IN PARTICULAR DOUBLE-WALL PANEL

The invention relates to a wall panel for building a wall, in particular for building a large shuttering wall, from a plurality of wall panels whose lateral abutment edges flushly abut each other, the wall panel comprising a main plate having rectilinear first and second lateral abutment edges parallel to each other on a first large face of the main plate.

Wall panels according to the invention serve in particular to build large prefabricated shuttering walls. However, the invention may also be utilized in wall panels of any other type, such as for building confinements of fair stands, or partitions.

Large shuttering walls prefabricated in the form of such panels afford the advantage that a minimum number of joints exist in the wall area, such joints requiring a relatively great amount of labour during mounting as well as surface finishing of the erected wall. (During the mounting stage, shuttering and bracing work has to be carried out and concrete has to be filled in to form the wall; afterwards, the joints have to be bandaged and plaster coated to provide smooth wall surfaces.) So far, such prefabricated large shuttering walls have been known only as panels made of wooden material; however, these panels do not always meet the quality requirements of exterior wall surfaces in building constructions, since such panels are inflammable and are subject to decay.

The invention solves the problem of how to design wall panels of the abovementioned type such that they can be manufactured in relatively small dimensions also from other materials than wood, in particular from a cement-cured material, and can be quickly assembled to a large wall.

According to the invention, this object is achieved by the features that on the other large face of the main plate a platelike suspension tooth projecting from the first abutment edge is arranged behind the first abutment edge, while a suspension recess adapted to the suspension tooth is arranged behind the second abutment edge, the lower edge face of the suspension tooth and the lower confining edge of the suspension recess being oblique and descending from the associated abutment edges at a same acute angle with respect to the abutment edges such that the suspension tooth of the main plate of the wall panel can be suspended in the suspension recess of the main plate of another wall panel of the same type by sliding the suspension tooth into the suspension recess of the other wall panel until the abutment edges of the two wall panels adjoining each other come into contact with one another.

The wall panel design according to the invention allows a second wall panel to be relatively easily suspended, for instance by a building crane, in a first wall panel already erected; this is achieved by lifting the suspension tooth of the second wall panel up to the suspension recess of the first double-wall panel, then inserting the suspension tooth laterally into the suspension recess, and finally lowering the second wall panel such as to make the lower edge face of its suspension tooth slide downward—on the lower confining edge of the suspension recess of the first wall panel—into the suspension recess until the abutment edges adjoining each other come into contact with one another.

While the wall panel may be arranged as a single-wall panel comprising only one main plate, the preferred embodiment of the invention envisages a double-wall panel design in that a second main plate identical to the first mentioned main plate is arranged at a distance from and parallel to the first main plate, that the two main plates face each other by their large faces which comprise the suspension teeth and suspension recesses, and are held together defining a double-wall panel, the suspension teeth and suspension recesses of the second main plate being disposed at the same lateral edges of the second main plate as the suspension teeth and suspension recesses, respectively, of the first main plate.

Such a double-wall panel achieves an additional advantage during assembly in that the flat exterior sides of the suspension teeth of the second double-wall panel to be suspended are slidably guided, also transversely to the main plates, by the flat surfaces of the main plate confining the suspension recesses, as the suspension teeth arranged on the interior sides of the main plates are inserted between the main plates. As a result, the suspension of the second double-wall panel at the same time ensures positive interconnection of the double-wall panels in the horizontal direction as well as downwardly and transversely to the plane of the main plates.

Moreover, by arranging the suspension teeth and the suspension recesses on the inner sides of the main plates behind the abutment edges (as viewed from outside), the suspension teeth and the suspension recesses are covered towards the exterior after assembly of the double-wall panels, so that only the rectilinear joints between the adjoining abutment edges are visible from outside.

Such double-wall panels preferably serve to build large interlinked shuttering walls in which the main plates are rigidly connected to each other by spacers, for example. Double-wall panels according to the invention provide a further advantage in that their stability enables them to be assembled to a large double-wall using substantially no, or only a few, supporting or shuttering means.

The acute angle defined by the lower edge faces of the suspension teeth and the lower confining edges of the suspension recesses with respect to the plane of the associated adjoining abutment edges, should preferably not be too obtuse nor too acute. A favourable range has turned out to be 30° to 60°, in particular 45°. On the other hand, the suspension teeth and suspension recesses may also be formed in a different way; however, preferred embodiments comprise oblique lower edges extending downwardly.

In the following disclosure, preferred embodiments of the invention are described in relation to double-wall panels; however, the features disclosed may be likewise applied to single-wall panels.

According to a particularly preferred embodiment of the invention, the suspension teeth and the suspension recesses are each laterally offset from the plane of the associated abutment edges so that a groove is provided at the lateral edges of the main plates comprising the suspension teeth; the lateral abutment edge of the adjoining main plate comprising the suspension recess engages this groove; as a result, the joint is completely covered from inside.

Although the suspension teeth may be flush with the inner sides of the main plates, the suspension teeth and plate parts confining the suspension recesses are preferably attached to the respective flat inner faces of the main plates.

In this arrangement, the suspension teeth and the plate parts confining the suspension recesses may be attached as individual parts to the inner faces of the main plates. However, it is also possible to form the suspension teeth and/or suspension recesses on respective ledges extending throughout the height of the main plates. This allows the suspension teeth and suspension recesses to be easily manufactured by cutting an elongate ledge out of a plate, this ledge comprising the suspension teeth and defining the "negative" of a further ledge comprising the suspension recesses. In this way, manufacturing of the ledges can be carried out in a very economical manner with respect to the material used. The two different ledges can then be mounted to the associated lateral edges of the main plates. In both cases, waste material left from the cutting of the main plates which would normally have to be disposed of, can be used to form the suspension teeth and the plate parts confining the suspension recesses.

Basically, it may suffice to provide one suspension tooth and one suspension recess, respectively, at the lateral edges of the main plates, depending on the height of the main plates. Preferably, however, each lateral edge of the main plates comprises a plurality of suspension teeth and suspension recesses, respectively. This allows a more stable connection to be accomplished between the double-wall panels adjoining each other. According to an advantageous design of the invention, the distribution density of the suspension teeth and suspension recesses, respectively, at the adjacent lateral edges may be greater in the lower portion of the wall panel than in its upper portion. This construction ensures an enhanced connection strength in the lower panel portion which is more intensively stressed due to the pressure of the liquid concrete filled between the main plates when the double-wall panels are used as shuttering elements.

If the suspension teeth are each formed as individual plates attached to the main plate, intermediate pieces may be inserted in the gaps between the suspension teeth, resulting in a more stable structure and a more precise positioning of the suspension teeth; moreover, the joint can thus be covered even in the areas between successive suspension teeth by intermediate pieces projecting from the abutment edge. Such covering can also be achieved by the abovementioned ledge carrying the suspension teeth if the ledge projects laterally from the abutment edge.

Apart from a necessary play, the suspension recesses may be formed complementary to the suspension teeth. It is preferred, however, that the height of the suspension recess—measured parallel to the abutment edges—is greater than the corresponding height of the suspension tooth. This facilitates mounting of the double-wall panels.

Advantageously, the double-wall panel is made of a substantially cement-cured material, plaster or wood. The choice of the material is made in accordance with the particular application, e.g. an application as a partition or the like, or as a lost shuttering.

Although the double-wall panels may be assembled on site to form the double wall, it is preferred according to the invention that the wall panels are assembled and connected to each other already at the factory to form a prefabricated large double-wall; this can be achieved by gluing or any other connecting technique such as screwing, riveting or dowelling and the like. Therefore, the invention also relates to such a prefabricated double-wall panel. In so doing, fitting pieces as well as all necessary openings, such as doors, windows, channels and the like, can already be provided at the factory.

In the following, the invention will be explained in greater detail by means of exemplary embodiments having reference to the drawings in which FIGS. 1*a* and 1*b* are a perspective view of part of a first lateral edge of a double-wall panel;

FIGS. 2*a* and 2*b* are a perspective view of part of the other lateral edge of the double-wall panel;

Figure 1A:
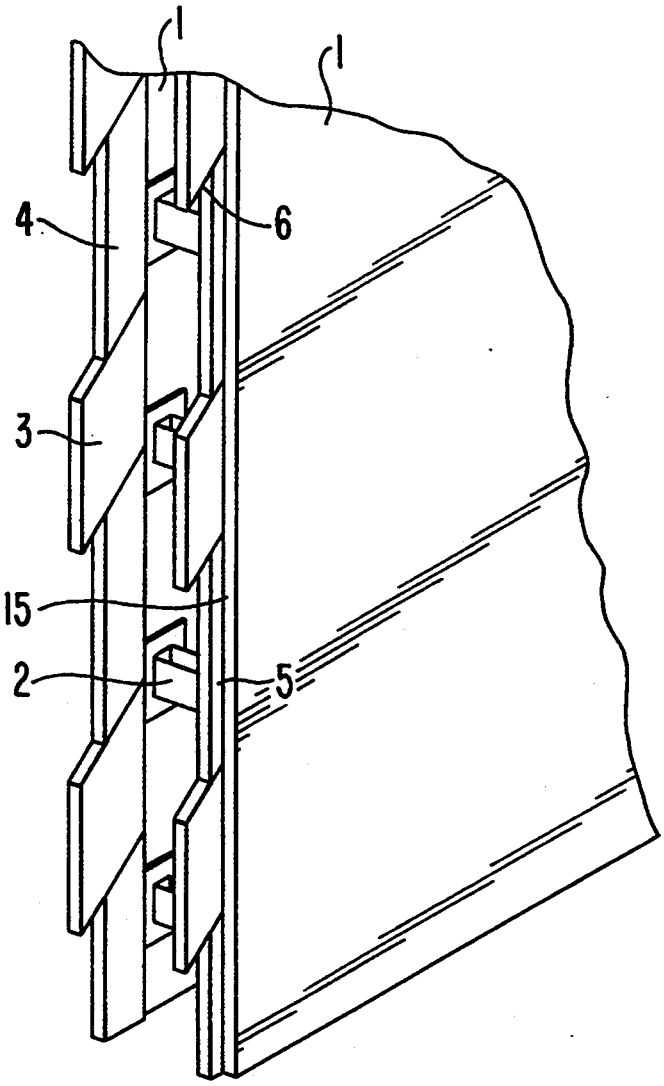
Figure 1B:
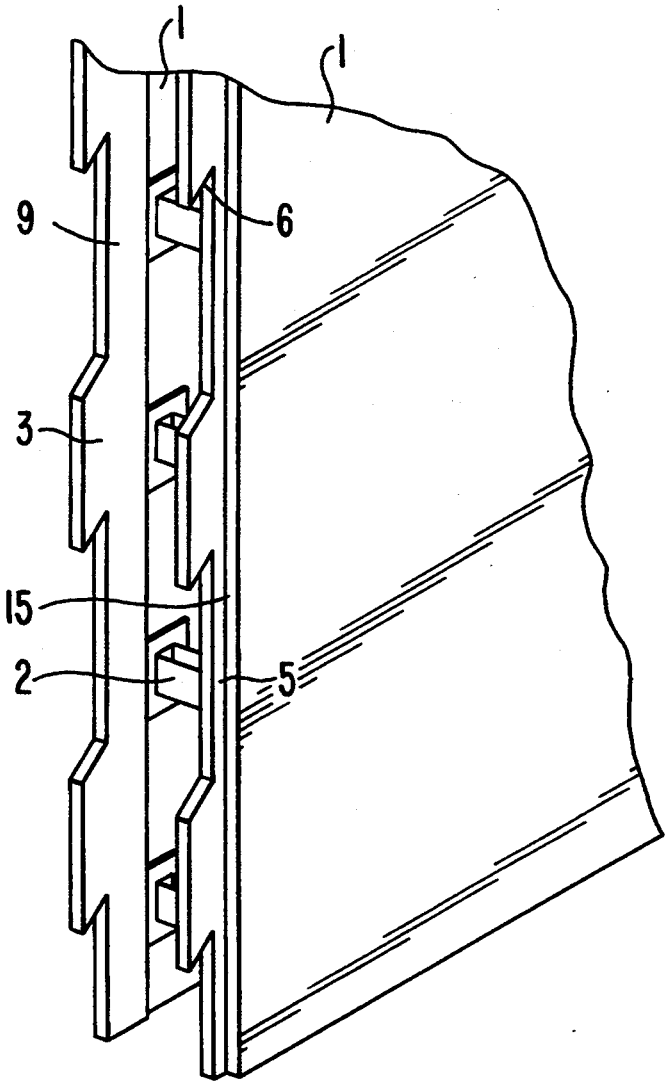
Figure 5:
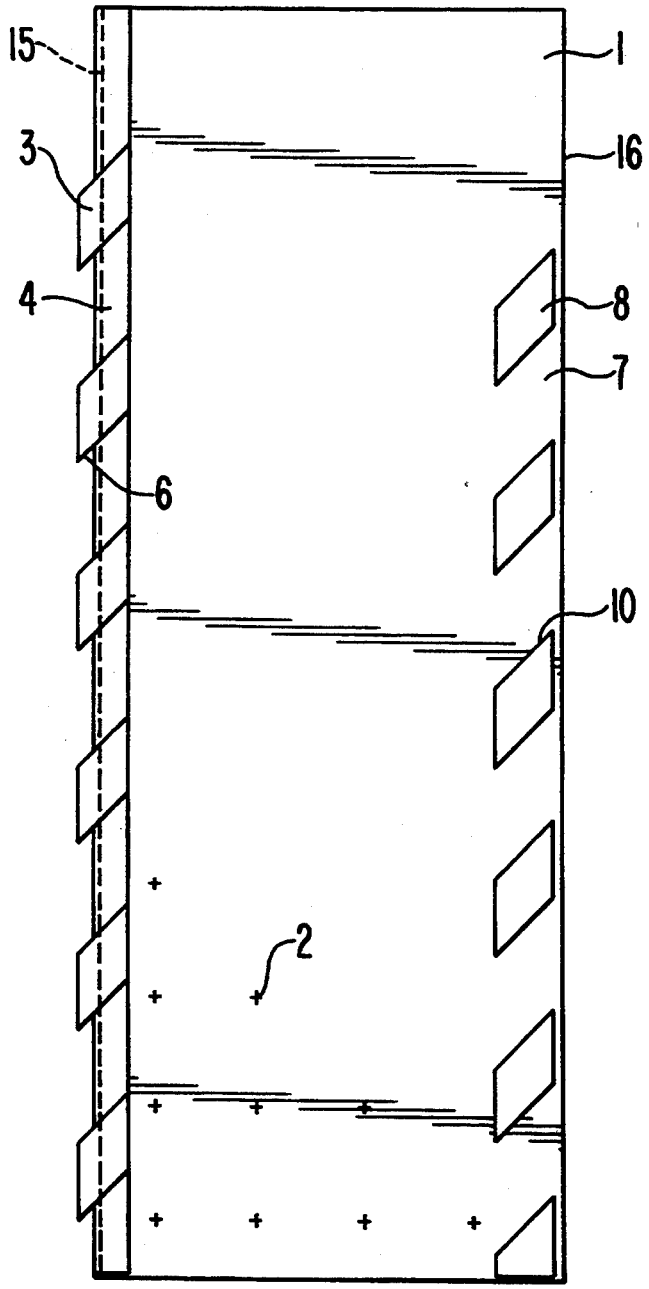

FIG. 5 is a side elevational view of a main plate, as viewed from the inner side, i.e. from the space between the main plates. As can be seen in FIGS. 1*a* and 1*b*, the double-wall panel comprises two main plates 1 extending parallel to each other. In the embodiment shown, the two main plates 1 are connected to each other by spacers 2 which hold the main plates 1 firmly together in their parallel position. However, it is also possible to hold the main plates 1 firmly together by any other means, e.g. by screws and sleeves.

The two lateral edge faces of the main plates 1 define lateral abutment edges 15, 16 resting flush on the abutment edges of the main plates of the respective adjoining double-wall panel elements.

According to FIGS. 1*a* and 1*b*, platelike suspension teeth 3 projecting outwardly from the abutment edge 15 are secured to the inner sides of the main plates 1 facing each other; the suspension teeth 3 are arranged behind the abutment edges 15 such that the plane of the teeth plates 3 is parallel to the main plates 1. These suspension teeth 3 can be glued, screwed or fastened in any other manner to the main plate 1. The lower edge face 6 of each platelike suspension tooth 3 projecting outwardly from the abutment edge 15 is oblique and descends from the plane of the abutment edge 15 at an angle, this angle being 45° in the exemplary embodiment shown. While FIG. 1*a* illustrates the suspension teeth 3 as individual plate pieces between which intermediate pieces 4 are inserted and also secured to the main plate 1, the suspension teeth 3 shown in FIG. 1*b* are formed at a common ledge 9.

According to further perspective illustrations given in

Figure 2A:
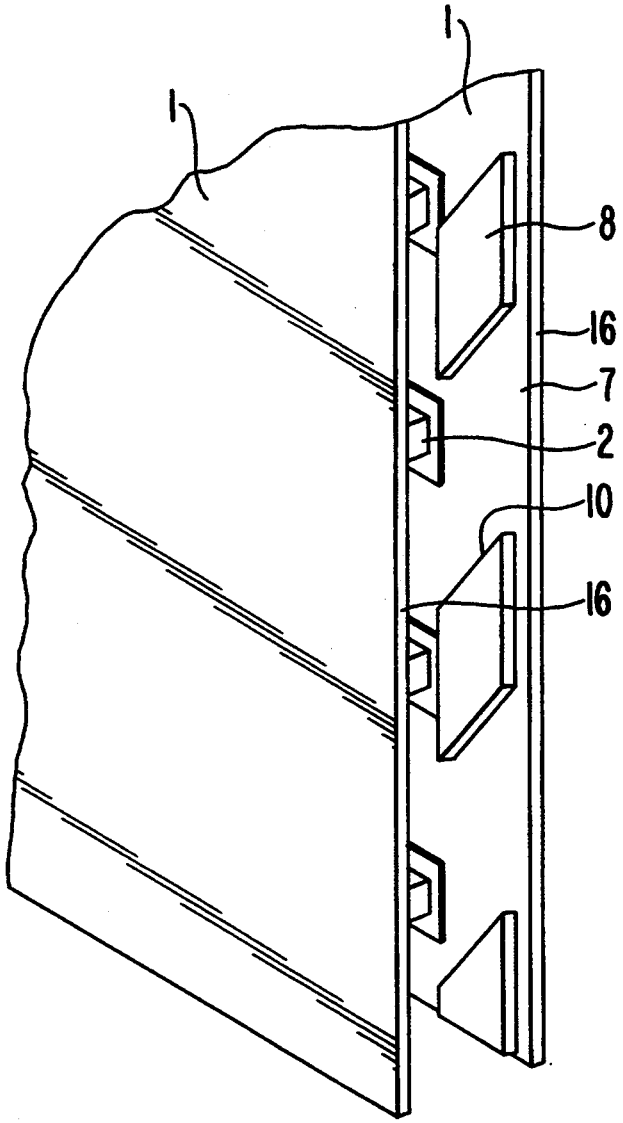
Figure 2B:
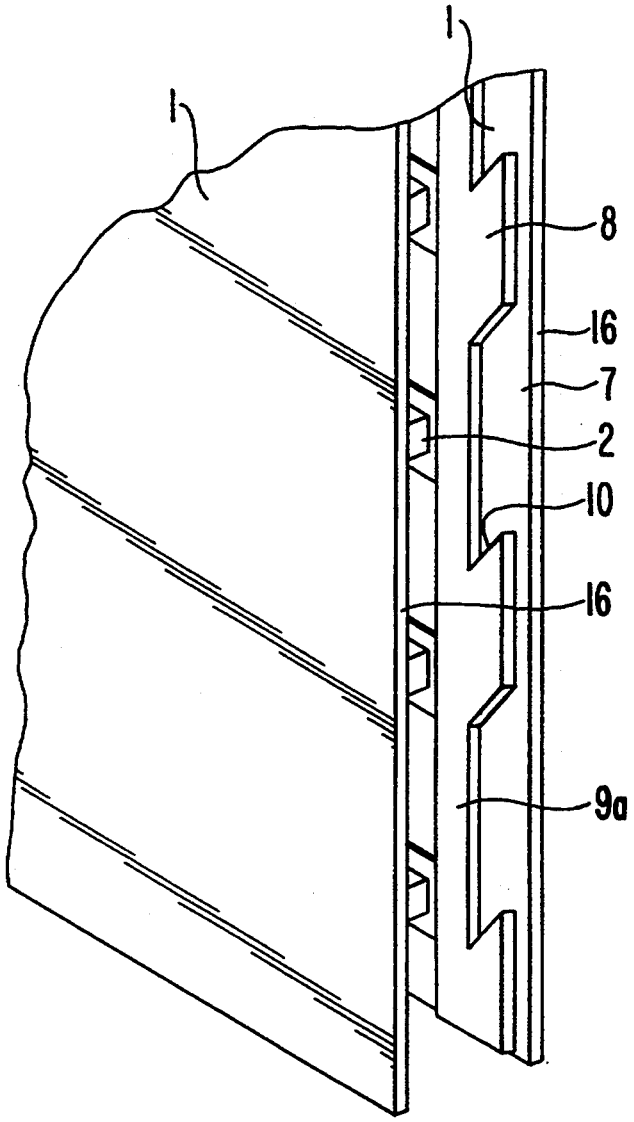

FIGS. 2*a* and 2*b* , suspension recesses 7 are formed behind the abutment edge 16 and are each confined vertically by two plate parts 8. The lower confining edges 10 of the suspension recesses 7 are oblique and descend towards the centre of the main plates 1 at the same angle as the lower edge faces 6 of the suspension teeth 3. Like the suspension teeth 3, the plate parts 8 are attached to the main plates 1 by gluing, screwing or in any other manner. In the embodiment shown in FIG. 2*a*, the plate parts 8 are formed as individual pieces, whereas they are formed at a common ledge 9*a* according to the embodiment shown in FIG. 2*b*.

The double-wall panels can thus be assembled such that the suspension teeth 3 of the first double-wall panel engage the suspension recesses 7 of the other double-wall panel, the abutment edges 15, 16 of the double-wall panels abutting each other. The assembled double-wall panels are therefore firmly interlocked.

The spaces between the rhombic suspension teeth 3 may be filled with rhombic platelike intermediate pieces 4 arranged on the inner side of the main plate 1; the outer side edges of the intermediate pieces 4 project slightly from the abutment edge 15 such that a groove 5 is defined by the suspension teeth 3 and the projecting side edges of the intermediate pieces 4 on the one hand, and by the abutment edge 15 on the other hand. Accordingly, the rhombic plate parts 8 between which the suspension recesses 7 are defined, are offset from the abutment edge 16 so that when two double-wall panels are assembled, the lateral edge of a main plate 1 defining the abutment edge 16 of a double-wall panel can engage the groove 5 of the adjacent main plate 1 of the other double-wall panel, thus covering from inside the joint between the abutment edges 15 and 16. Similar covering is achieved in the embodiment of FIG. 1*b* by arranging the ledge 9 such that its continuous portion projects from the abutment edge 15.

Figure 3:
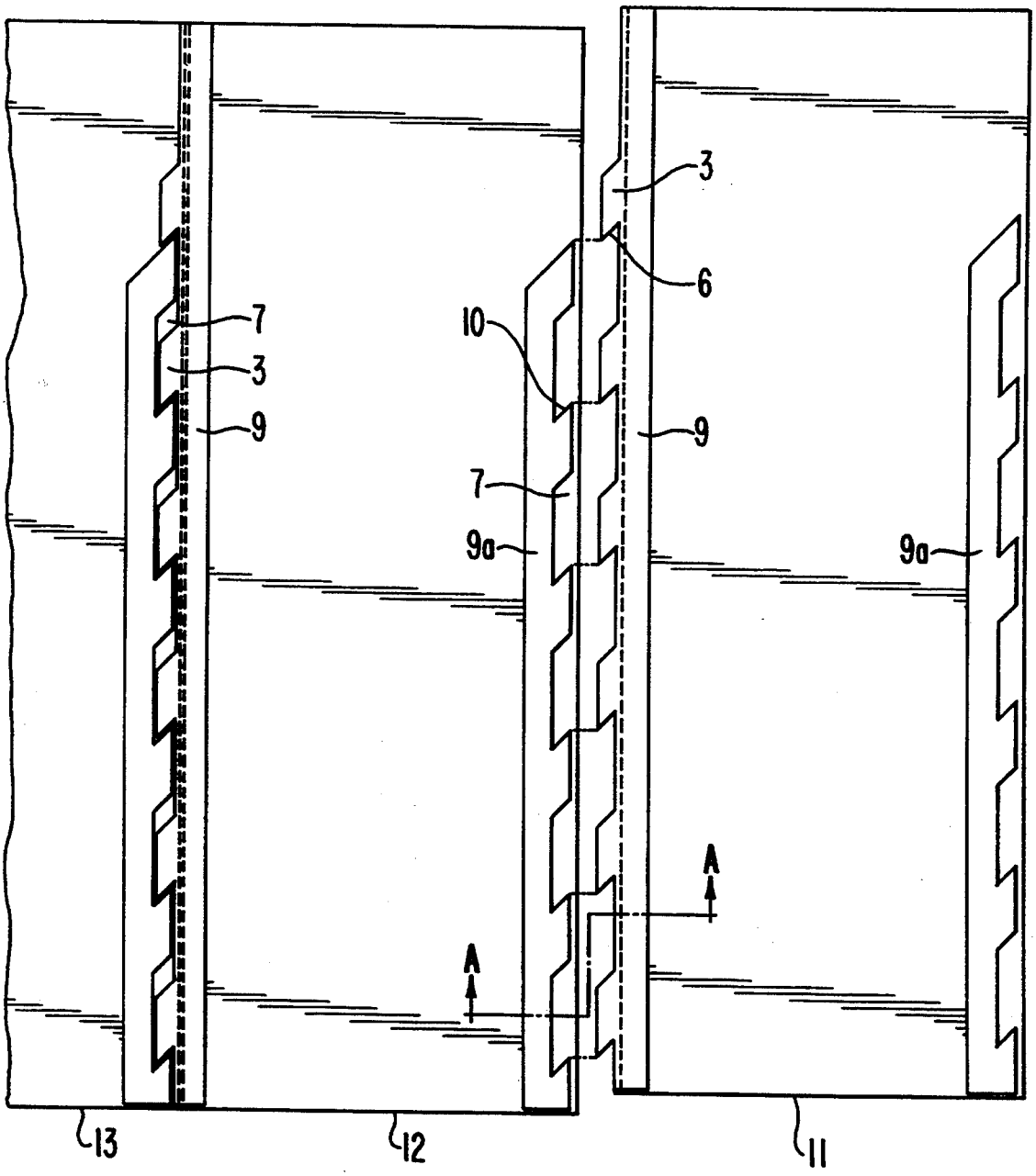
FIG. 3 is a side elevational view of two interlinked main plates of two double-wall panels, and of a third double-wall panel being suspended, looking at the inner sides of the main plates.

As can be seen in the left-hand part of FIG. 3, the vertical dimension of the suspension recesses 7 is greater than that of the suspension teeth 3, allowing the suspension teeth 3 to be easily inserted laterally in the suspension recesses 7. As is apparent from FIG. 3, a double-wall panel 11 is being fitted to a double-wall panel 12 which in turn has already been fitted firmly to a double-wall panel 13.

When the double-wall panel 11 is to be fitted to the double-wall panel 12, the double-wall panel 11 may be lifted by means of a building crane, then inserted laterally into the suspension recesses 7 of the other double-wall panel 12, and finally lowered such as to make the suspension teeth 3 slide downward—on the respective lower confining edges 10 of the suspension recesses 7—into the suspension recesses 7 until the abutment edges 15 and 16 of the main plates 1 of the double-wall panels 11, 12 come into contact with each other. In this position, the double-wall panels are positively interlocked, as shown in relation to the double-wall panels 12 and 13 in the left-hand part of FIG. 3. The individual double-wall panels may be additionally glued or fixed together in any other manner; in particular, they may be assembled to form a prefabricated large wall panel.

Figure 4:
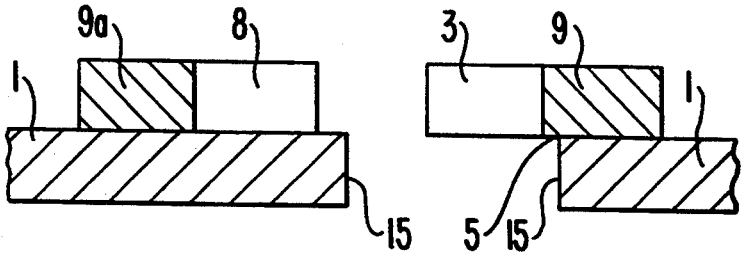
FIG. 4 is a sectional view along line A—A in FIG. 3.

Incidentally, in the embodiments shown in FIGS. 3 and 4, the suspension teeth 3 and the suspension recesses 7 are formed at respective ledges 9 and 9*a* attached to the inner sides of the main plates 1.

I claim:

1. A wall panel comprising:

first and second parallel plates separated from and connected to one another by central spacers, each plate having an inner surface and first and second parallel abutment edges;

a plurality of spaced suspension teeth attached to the inner surface of each plate proximate the first abutment edge and projecting outwardly beyond the first abutment edge, each suspension tooth of said plurality including a lower edge face defining an acute angle with respect to the first abutment edge, the teeth of the first plate being separated from the teeth of the second plate so as to define a gap therebetween; and a plurality of spaced receiving elements attached to the inner surface of each plate proximate the second abutment edge, the receiving elements defining a plurality of recesses, each having a lower confining edge defining the acute angle with respect to the second abutment edge, the receiving elements of the first plate being separated from the receiving elements of the second plate so as to define a second gap therebetween, the suspension teeth corresponding to the recesses so that the suspension teeth of a first wall panel can be received by the recesses of a second identical wall panel such that the abutment edges of said first wall panel can contact the abutment edges of said second identical wall panel.

2. The wall panel according to claim 1, wherein a common ledge comprises the plurality of receiving elements.

3. The wall panel according to claim 1, further comprising an intermediate piece attached to the inner surface of each plate in each space between adjacent suspension teeth, each intermediate piece projecting outwardly beyond the first abutment edge to define a groove corresponding in shape to one of said receiving elements.

4. The wall panel according to claim 3, wherein a common ledge comprises the intermediate pieces and suspension teeth of each inner surface.

5. The wall panel according to claim 1, wherein a greater number of suspension teeth and receiving elements are distributed on a lower portion of the wall panel than on an upper portion of the wall panel.

6. The wall panel according to claim 1, wherein the dimension of each recess measured parallel to the second abutment edge is greater than the corresponding dimension of the corresponding suspension tooth.

7. The wall panel according to claim 1, wherein the wall panel is formed substantially of one of the group consisting of a cement-cured material, plaster, and wood.

8. A double-wall panel for building a large shuttering double-wall from a plurality of double-wall panels whose lateral abutment edges abut to be flush with each other, the double-wall panel comprising:

first and second main plates, each having rectilinear first and second lateral abutment edges, the edges being parallel to each other and provided at first and second ends of the main plates, the plates being attached and parallel to each other so as to define a continuous gap therebetween;

at least one suspension tooth projecting from and arranged behind the first abutment edge of each plate, each tooth having a lower edge face;

at least one suspension recess corresponding in shape to the suspension tooth and arranged behind the second abutment edge of each plate, each recess having a lower confining edge;

the edge face and the confining edge being at a common acute angle with respect to the corresponding abutment edges so that the suspension tooth of one double-wall panel can be suspended in the suspension recess of a second double-wall panel and the abutment edges of the two identical double-wall panel such that the abutment edges of said one double-wall panel can contact the abutment edges of said second identical double-wall panel one another.

9. A wall panel comprising:

first and second parallel plates separated from and connected to each other so as to define a continuous gap therebetween, each plate having an inner surface and first and second parallel abutment edges;

at least one suspension tooth attached to the inner surface of each plate proximate the first abutment edge and projecting outwardly beyond the first abutment edge, each suspension tooth including a lower edge face defining an acute angle with respect to the first abutment edge; and at least one receiving element attached to the inner surface of each plate proximate the second abutment edge, the receiving element defining at least one recess having a lower confining edge defining the acute angle with respect to the second abutment edge, the at least one suspension tooth corresponding to the at least one recess so that the at least one suspension tooth of a first wall panel can be received by the at least one recess of a second identical wall panel such that the abutment edges of said first wall panel can contact the abutment edges of said second identical wall panel.

10. The wall panel according to claim 9, further comprising a plurality of suspension teeth and a plurality of receiving elements, the receiving elements defining a plurality of recesses, the suspension teeth corresponding to the recesses so that the suspension teeth of a first wall panel can be received by the recesses of a second identical wall panel such that the abutment edges of said first wall panel can contact the abutment edges of said second identical wall panel.

11. The wall panel according to claim 9, wherein the at least one suspension tooth of the first plate is separated from the at least one suspension tooth of the second plate so as to define a second gap therebetween.

12. The wall panel according to claim 11, wherein the at least one receiving element of the first plate is separated from the at least one receiving element of the second plate so as to define a third gap therebetween.

* * * * *

UNITED STATES PATENT AND TRADEMARK OFFICE

CERTIFICATE OF CORRECTION

PATENT NO. : 5,428,932

DATED : July 4, 1995

INVENTOR(S) : Eva GRUBER

It is certified that error appears in the above-indentified patent and that said Letters Patent is hereby corrected as shown below:

Claim 8, column 6, lines 59-60, after "second" delete "double-wall panel and the abutment edges of the two; and lines 63-64, delete "one another".

Signed and Sealed this

Twenty-ninth Day of August, 1995

*Attest:*

Bruce Lehman

BRUCE LEHMAN

*Attesting Officer*

*Commissioner of Patents and Trademarks*